US005167391A

United States Patent [19]

Simpson

[11] Patent Number: 5,167,391

[45] Date of Patent: Dec. 1, 1992

[54] PRODUCT MERCHANDISER ASSEMBLY HANGER

[75] Inventor: Peter Simpson, 1430 Watersedge Road, Mississauga, Ontario, L5J 1A4, Canada

[73] Assignee: Peter Simpson, Reydale, Canada

[21] Appl. No.: 737,185

[22] Filed: Jul. 29, 1991

[51] Int. Cl.[5] ..... A47B 96/06

[52] U.S. Cl. ..... 248/220.2; 211/103; 211/186; 248/231.7; 248/245

[58] Field of Search ..... 248/235, 225.31, 231.7, 248/250, 245, 220.2, 225.2, 243, 249, 297.2; 211/87, 88, 90, 133, 186, 103, 187; 108/47, 144, 153

[56] References Cited

U.S. PATENT DOCUMENTS

| | | | |
|---|---|---|---|
| 759,560 | 5/1904 | Sharp | 248/231.7 |
| 1,758,976 | 5/1930 | Rice | 211/186 |
| 1,940,454 | 12/1933 | Karnes | 248/250 |
| 2,367,256 | 1/1945 | Atkins | 248/231.7 X |
| 2,940,604 | 6/1960 | Bolton | 248/222.2 |
| 2,971,805 | 2/1961 | Weiss | 248/220.2 X |
| 3,291,427 | 12/1966 | Hutchings | 211/89 X |
| 3,450,270 | 6/1969 | Brown | 248/243 X |
| 3,537,596 | 11/1970 | Brunette | 211/186 |
| 3,643,902 | 2/1972 | Gualano | 248/231.7 X |
| 4,059,248 | 11/1977 | Kuntz | 248/225.31 X |
| 4,102,089 | 7/1978 | Pousley | 248/243 X |
| 4,898,355 | 2/1990 | Steinway | 248/250 X |
| 4,913,391 | 4/1990 | Klipp | 248/231.7 X |
| 5,048,701 | 9/1991 | Simpson | 211/189 |

FOREIGN PATENT DOCUMENTS

| | | | |
|---|---|---|---|
| 1141020 | 1/1969 | United Kingdom | 211/186 |

*Primary Examiner*—Ramon O. Ramirez
*Assistant Examiner*—Derek J. Berger

[57] ABSTRACT

A product merchandiser mount of the present invention is located at an end of an upright wall and is used to support a hanger arm suspended to one side of the wall. The mount comprises a front portion with a forwardly opening hanger arm receiving channel and a side portion angled relative to and extending rearwardly from the front portion to provide a fitting shaped to the end of the wall.

10 Claims, 4 Drawing Sheets

PRODUCT MERCHANDISER ASSEMBLY HANGER

FIELD OF THE INVENTION

The present invention relates to a mount which fits to one end of an upright wall typically a shelf supporting wall and is used to support a product merchandiser assembly extending outwardly to one side of the wall.

BACKGROUND OF THE INVENTION

I have recently developed a product merchandiser assembly which fits to an existing shelf supporting upright wall or backboard. In my product merchandiser a hanger arm is supported at one end and extends outwardly to one side of the upright wall to receive a product merchandiser carton. The end of the wall is typically dead space and the product merchandiser not only adds merchandising space but in addition enhances the appearance of the existing shelf.

Some upright walls are built with a pegged or pinned end to which the hanger arm of my merchandiser will fit as disclosed in my co-pending Canadian Patent Application Ser. No. 2,022,515-7, filed Aug. 2, 1990 and the corresponding U.S. application Ser. No. 568,975, filed Aug. 17, 1990. These two co-pending applications describe arrangements in which the wall end receives the hanger arm without any modifications to the wall. It is however equally desirable to use the product merchandiser on an upright wall having a solid wall end which, without modification, would not be capable of receiving the product merchandiser.

SUMMARY OF THE PRESENT INVENTION

The present invention provides a mount for a product merchandiser in which the mount is located at an end of an upright wall, preferably a shelf supporting wall and the mount supports a hanger arm suspended to one side of the wall. The mount comprises a front portion with a forwardly opening hanger arm receiving channel and a side portion angled relative to and extending rearwardly from the front portion to provide a fitting shaped to the end of the wall.

BRIEF DESCRIPTION OF THE DRAWINGS

The above as well as other advantages and features of the present invention will be described in greater detail according to the preferred embodiments of the present invention in which.

Figure 1:
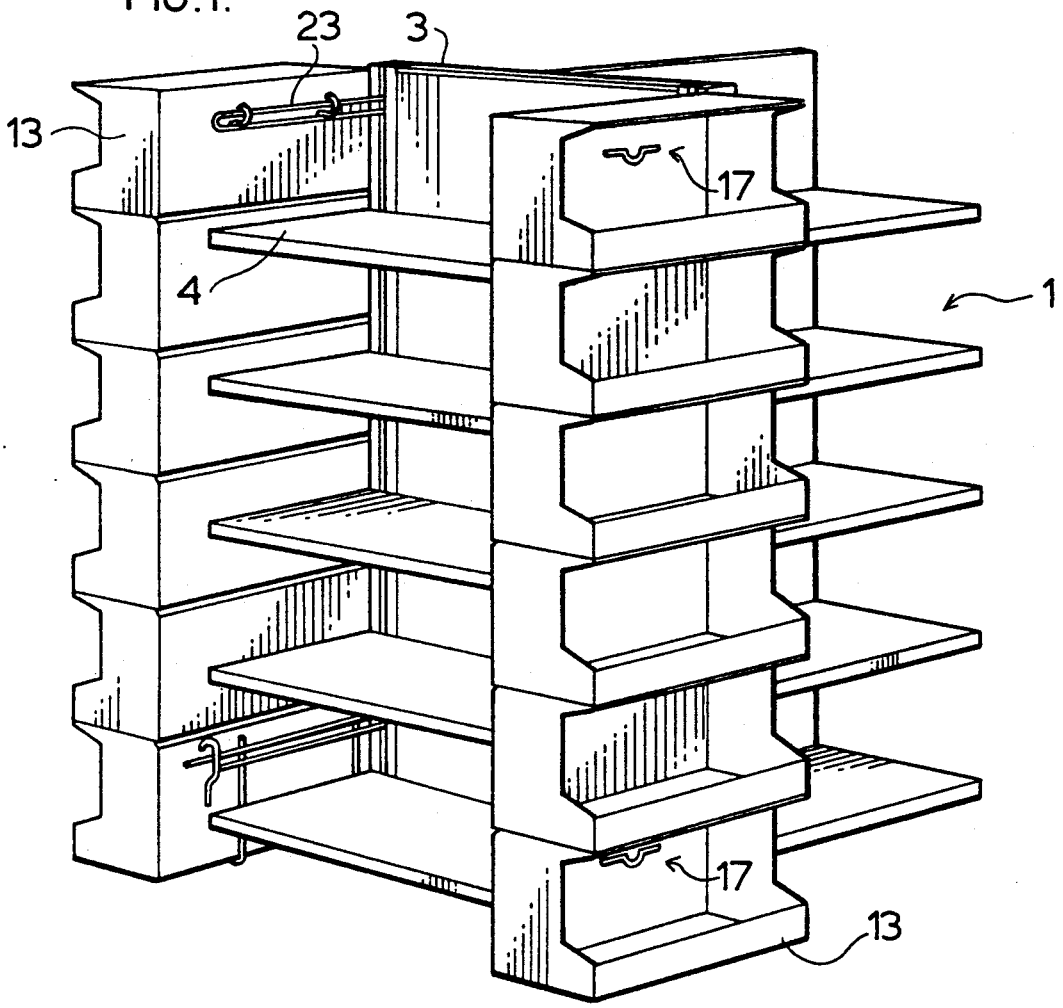
FIG. 1 is a perspective view of a shelf supporting upright wall with product merchandisers located to each side and supported at each end of the wall.
Figure 2:
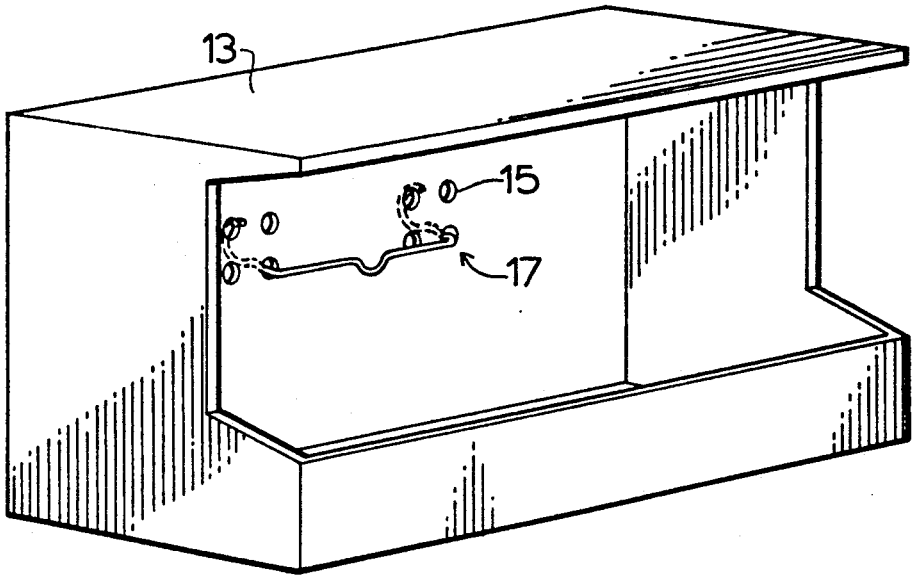
FIG. 2 is an enlarged perspective view of the product merchandiser carton or box which is covered in my earlier co-pending applications.

DETAILED DESCRIPTION ACCORDING TO THE PREFERRED EMBODIMENTS OF THE PRESENT INVENTION:

FIG. 1 shows an overall merchandiser assembly generally indicated at 1. This merchandiser assembly comprises an upright wall 3 having a wall end 3*a* best seen in FIGS. 3 and 4 of the drawings. Wall end 3*b* shown in FIG. 7 of the drawings is a slightly modified wall end. The opposite sides of wall 3 are fitted with horizontal shelves 4. Wall 3 and shelves 4 are relatively standard merchandisers.

Provided to each end of wall 3 is a merchandiser assembly which I have described in my earlier filed co-pending applications. This merchandiser assembly comprises an arm generally indicated at 23 supported at the wall end and suspended out to each side of the wall 3. Arm 23 supports a merchandiser box 13 which includes an apertured back wall 15 for receiving a clip 17. Clip 17 fits through the apertured back wall 15 of box 13 and onto arm 23 as is again well described in my co-pending applications.

Figure 3:
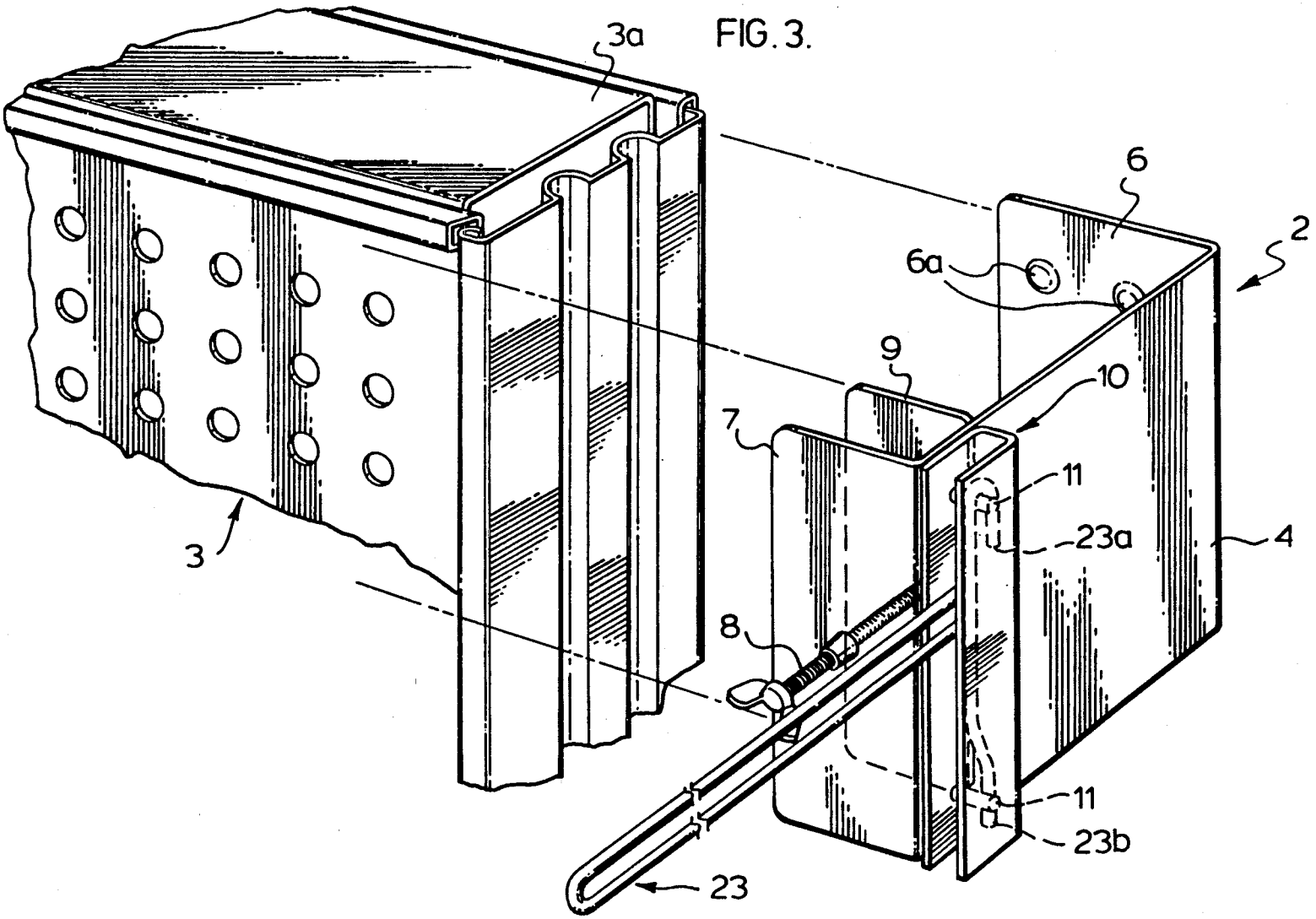
FIG. 3 is an enlarged perspective view of a mount according to a preferred embodiment of the present invention to be secured to the end of an upright wall.
Figure 4:
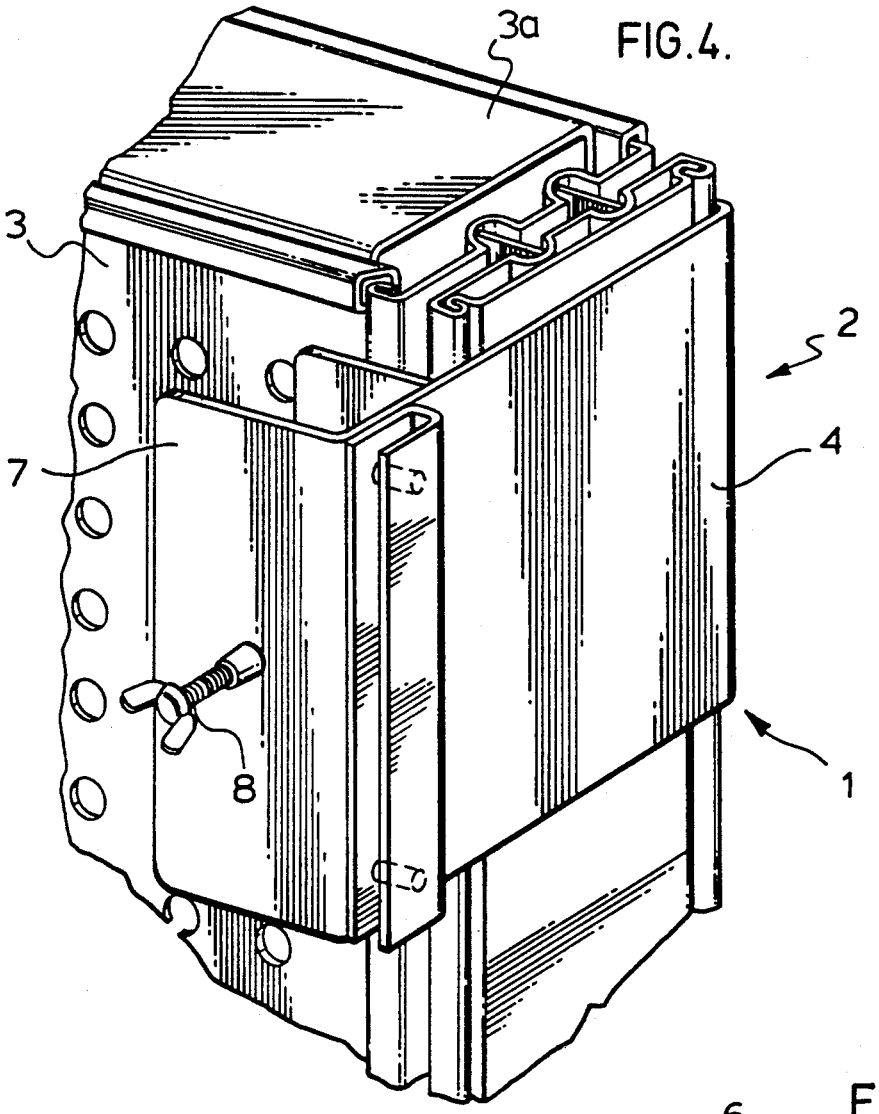
FIG. 4 shows the securing of the mount of FIG. 3 to the end of the upright wall.
Figure 5:
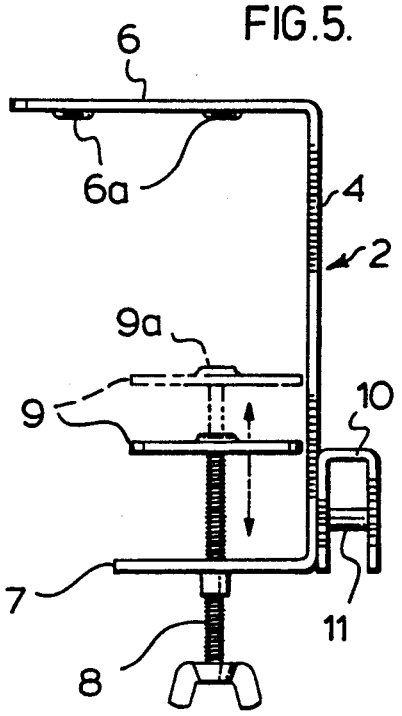
FIG. 5 is a top view of the mount shown in FIG. 3.
Figure 7:
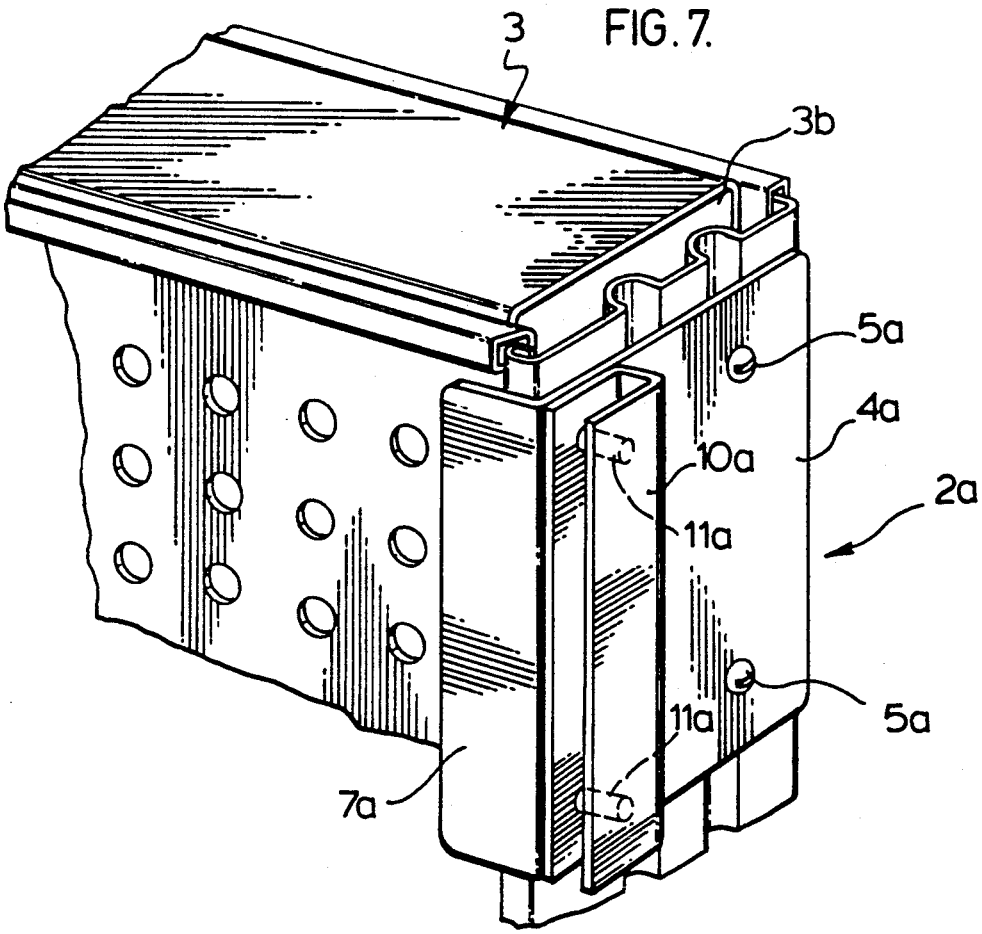
FIG. 6 is a perspective view of a further preferred embodiment mount and FIG. 7 is a perspective view of the mount of FIG. 6 secured to the end of an upright wall.
Figure 6:
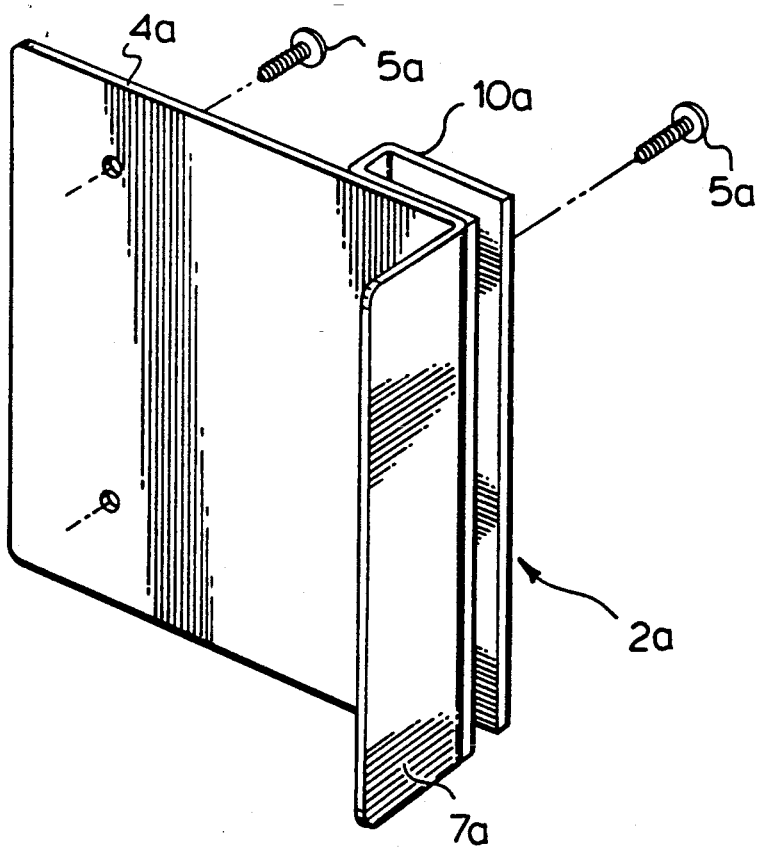

According to the present invention, a wall end mount is provided for receiving hanger arm 23. FIGS. 3 through 5 show one embodiment of the mount generally indicated at 2 while FIGS. 6 and 7 show another embodiment of the mount generally indicated at 2*a*. Each of these mounts fits directly to an end of an upright wall and includes a securing region for receiving the mounting end of the hanger arm. Each one of the mounts 2 and 2*a* eliminates the need to have any type of a special design or configuration at the wall end for receiving the hanger arm.

Referring specifically to FIGS. 3 through 5, mount 2 includes a front portion in the form of a front face plate 7 with a forwardly opening channel to one end of the front face plate. Further provided is a side portion in the form of a side face plate 4 which extends rearwardly from one end of and at generally right angles to the front face plate 7. A back portion or back face plate 6 is turned at right angles to the side face plate parallel to the front face plate. As best seen in FIG. 3 the mount has the same general shape as and fits to the end of the wall.

Located between the front and back face plates is an interior movable plate 9. A bolt 8 threads through front face plate 7 and is rotationally secured to the interior plate 9. This arrangement provides an adjustable clamp between the interior movable plate 9 and the fixed position rear face plate 6.

Again, best seen in FIG. 3, mount 2 is open to one side and simply slips over the end 3*a* of wall 3. By adjusting the threaded bolt 8, the wall end is clamped between plates 6 and 9 to secure the mount to the wall end. In order to enhance the clamping action, plate 6 is provided with localized pressure producing bosses 6*a* with similar bosses 9*a* being provided on plate 9.

In my earlier filed applications, the wall end itself includes a channel-like region with mounting posts or pegs for the mounting end of the hanger arm. In the present application channel 10 includes vertically spaced apart posts or pins 11 extending transversely of the channel 10. Posts 11 are located approximately mid depth of the channel so as to leave an open area behind the channel posts. This enables the mounting ends 23*a* and 23*b* of the upper and lower spaced apart outer end connected arm portions of hanger arm 23 to hook onto the posts.

In designing the mount, the threaded bolt 8 is located at the front face plate 7. Therefore when the hanger arm 23 is suspended from the mount and the merchandiser box 13 is hung from the arm, the bolt is located behind the merchandiser box and away from any potential customer reaching into the box.

Mount 2*a* shown in FIG. 6, rather than being a clamp on body is secured by small screws to the wall end 3*b*. This mount again includes a front face plate 7*a* and a side face plate 4*a* at right angles to the front face plate. It does not however include anything in the way of a back face plate but rather the side face plate includes small openings for receiving screws 5*a* which thread directly into the wall end 3*b*. The front face plate and the side face plate are set at substantially 90° relative to one another where the front face plate provides a guide to locate the mount while the side face plate provides the region for actual securing of the mount to the wall end.

Also provided to the front side of mount 2*a* is a forwardly opening channel 10*a* including transverse pins or posts 11*a* onto which the mounting end of the hanger arm hooks for suspending the hanger arm outwardly to one side of the wall.

Although various preferred embodiments of the invention have been described in detail, it will be appreciated by those skilled in the art that variations may be made without departing from the spirit of the invention or the scope of the appended claims.

THE EMBODIMENTS OF THE INVENTION IN WHICH AN EXCLUSIVE PROPERTY OR PRIVILEGE IS CLAIMED ARE DEFINED AS FOLLOWS:

1. A merchandiser box mount comprising an end plate having an inner side and an outer side, a front plate extending to the inner side of and cooperative with said end plate in wrapping around and securing to an end of an upright panel, and a channel piece with a forward opening to the outer side of said end plate, said channel piece including an interior post traversing said channel piece and accessible through said forward opening.

2. A merchandiser box mount as claimed in claim 1 including a hanger arm removably secured to said interior post in said channel piece, said hanger arm extending forwardly of said front plate from the outer side of said end plate.

3. A merchandiser box mount as claimed in claim 2 wherein said channel piece extends vertically along said outer side of said end plate and includes upper and lower spaced apart posts in said channel member.

4. A merchandiser box mount as claimed in claim 1 wherein said channel piece is U-shaped including inner and outer sidewalls, said inner sidewall being secured to said outer side of said end plate.

5. A merchandiser box mount as claimed in claim 3 wherein said channel piece has a front to back depth, said posts being located about mid depth of said channel piece.

6. A merchandiser box mount as claimed in claim 3 wherein said hanger arm has an inner end and an outer end and has upper and lower arm portions which are separated at said inner end and connected to one another at said outer end of said hanger arm, said inner end of said hanger arm at said upper and lower arm portions being removably hooked over said upper and lower spaced apart posts in said channel member.

7. A merchandiser assembly comprising an upright panel having a product display face and an end on said panel and a product merchandiser box mount including an end plate and a front plate cooperative with one another wrapped around and secured to the end of said panel, and a channel piece with a forward opening secured to said end plate outwardly of said end and away from said forward face of said panel, said channel piece including an interior post traversing and accessible through said forward opening of said channel piece.

8. A merchandiser assembly as claimed in claim 7 including a hanger arm removably secured to said interior post in said channel piece, said hanger arm extending forwardly of said product display face and being located outwardly of said end of said panel.

9. A merchandiser assembly as claimed in claim 8 including a merchandiser box mounted on said hanger arm outwardly of said end of said panel at right angles to and away from said product display face.

10. A merchandiser assembly as claimed in claim 9 wherein said box mount includes a rear plate spaced from and parallel to said front plate, an adjustable clamp between said front plate and said rear plate and an adjustment member threadably fitted through said front plate to said clamp, said adjustment member being located behind and shielded by said merchandiser box.

* * * * *